US009046004B2

(12) United States Patent
Casavant et al.

(10) Patent No.: US 9,046,004 B2
(45) Date of Patent: Jun. 2, 2015

(54) COMPRESSION SLEEVE SEAL

(75) Inventors: Matthew Stephen Casavant, Greenville, SC (US); Brett Darrick Klingler, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 547 days.

(21) Appl. No.: 13/406,943

(22) Filed: Feb. 28, 2012

(65) Prior Publication Data

US 2013/0224005 A1 Aug. 29, 2013

(51) Int. Cl.
*F01D 25/24* (2006.01)

(52) U.S. Cl.
CPC ..... *F01D 25/243* (2013.01); *Y10T 29/49863* (2015.01); *F05D 2240/55* (2013.01); *F05D 2260/31* (2013.01)

(58) Field of Classification Search
CPC ..... F01D 25/265; F01D 25/243; Y10T 29/49863; F05D 2260/31; F05D 2240/55
USPC ..... 415/214.1, 213.1; 277/630, 637
See application file for complete search history.

(56) References Cited

U.S. PATENT DOCUMENTS

| | | | | |
|---|---|---|---|---|
| 2,457,073 | A * | 12/1948 | Stearns | 138/159 |
| 4,266,752 | A | 5/1981 | Johnson | |
| 4,398,695 | A | 8/1983 | Torche | |
| 5,253,875 | A * | 10/1993 | Gentile | 277/313 |
| 2003/0143069 | A1 * | 7/2003 | Kitazawa et al. | 415/199.5 |
| 2005/0012278 | A1 * | 1/2005 | DeLange | 277/602 |
| 2005/0047909 | A1 * | 3/2005 | Parry | 415/173.3 |
| 2009/0217900 | A1 * | 9/2009 | Salameh | 123/195 C |

FOREIGN PATENT DOCUMENTS

| | | | |
|---|---|---|---|
| EP | 2407646 | A1 | 1/2012 |
| GB | 718625 | * | 2/1953 |
| GB | 718625 | A | 11/1954 |

OTHER PUBLICATIONS

Search Report and Written Opinion from corresponding EP Application No. 13157037, dated May 24, 2013.

* cited by examiner

*Primary Examiner* — Dwayne J White
*Assistant Examiner* — Jason Fountain
(74) *Attorney, Agent, or Firm* — Nixon & Vanderhye, P.C.

(57) ABSTRACT

A seal for a turbine casing is provided. The turbine casing includes a plurality of sections joined at flanges provided on each section. Each flange includes a bore and a counterbore. The seal comprises a compression sleeve seal having a length that is greater than a counterbore-to-counterbore length of two flanges; a fastener configured to extend through the compression sleeve seal; and a nut threadable on each end of the fastener. The compression sleeve seal is compressible between each flange and each nut to create a first seal and is radially extensible to create a second seal against each bore.

22 Claims, 5 Drawing Sheets

COMPRESSION SLEEVE SEAL

This invention relates to a seal for containment of gas leakage across two opposed flanges of a pressure vessel structure such as a turbine casing. This invention also relates to a method of sealing a pressure vessel structure such as a gas turbine casing.

BACKGROUND OF THE INVENTION

In some pressure vessel applications, a gasket or seal is employed together with a flange connection to prevent a gas such as air from escaping through flange joints. For various technical reasons, some flange joints are employed which are not capable of totally sealing an air leak and some quantity of escaping air is acceptable, particularly where the amount of escaping air does not deleteriously affect the overall system of which the air is a part.

Gas turbines ordinarily utilize an air compressor having a cylindrical casing enclosing a cylindrical bladed rotor therein. Air at atmospheric pressure is ducted into the compressor at one open end of the cylinder to be compressed by the rotating blades of the rotor interengaging with blades in the casing. Air at elevated pressure is taken from the opposite end of the casing to be directed to combustion and exhaust system regions of the gas turbine apparatus which operate at a lower pressure. The compressor casing as well as intermediate parts of the casing between the compressor and the combustion system usually comprises a multipart arrangement of component sections suitably fastenered together with appropriate flanges. It has been found that excess air leakage may occur through the usual flat metal on metal engaging surface of the flanges of the multipart assembly, for example, because of thermal distortion of the flanges. Air leakage becomes an increasing problem where the casing structure includes curved and angled parts. It is difficult for the otherwise desirable machined surface flanges to maintain desired air sealing characteristics when the casing includes sections which are curved or at an angle to each other and the flanges are angled accordingly. For example, a flange may be utilized to seal to a horizontal as well as to a vertical surface and may utilize a single right angle flange to do so. The use of a gasket seal between the flanges is not only a deterrent to the more desirable metal to metal surface contact of the flanges, but also becomes a problem where the gasket seal might only be used where most air leakage occurs and therefore becomes an obstruction in the overall coextensive contact of the flange surfaces.

BRIEF DESCRIPTION OF THE INVENTION

According to one embodiment of the present invention, a seal for a turbine casing is provided. The turbine casing includes a plurality of sections joined at flanges provided on each section. Each flange includes a bore and a counterbore. The seal comprises a compression sleeve seal having a length that is greater than a counterbore-to-counterbore length of two flanges; a fastener configured to extend through the compression sleeve seal; and a nut threadable on each end of the fastener. The compression sleeve seal is compressible between each flange and each nut to create a first seal and is radially extensible to create a second seal against each bore.

According to another embodiment of the present invention, a method of sealing a turbine casing is provided. The turbine casing includes a plurality of sections joined at flanges provided on each section, each flange including a bore and a counterbore. The method comprises inserting a compression sleeve seal having a length that is greater than a counterbore-to-counterbore length of two flanges into the bores of two mating flanges; inserting a fastener into the compression sleeve seal; tensioning the fastener; threading a nut on each end of the fastener into contact with each end of the compression sleeve seal; and releasing the tension to compress the ends of the compression sleeve seal to form a first seal between each nut and each flange and radially extend the compression sleeve seal between the ends to form a second seal against the bores.

DETAILED DESCRIPTION OF THE INVENTION

Figure 1:
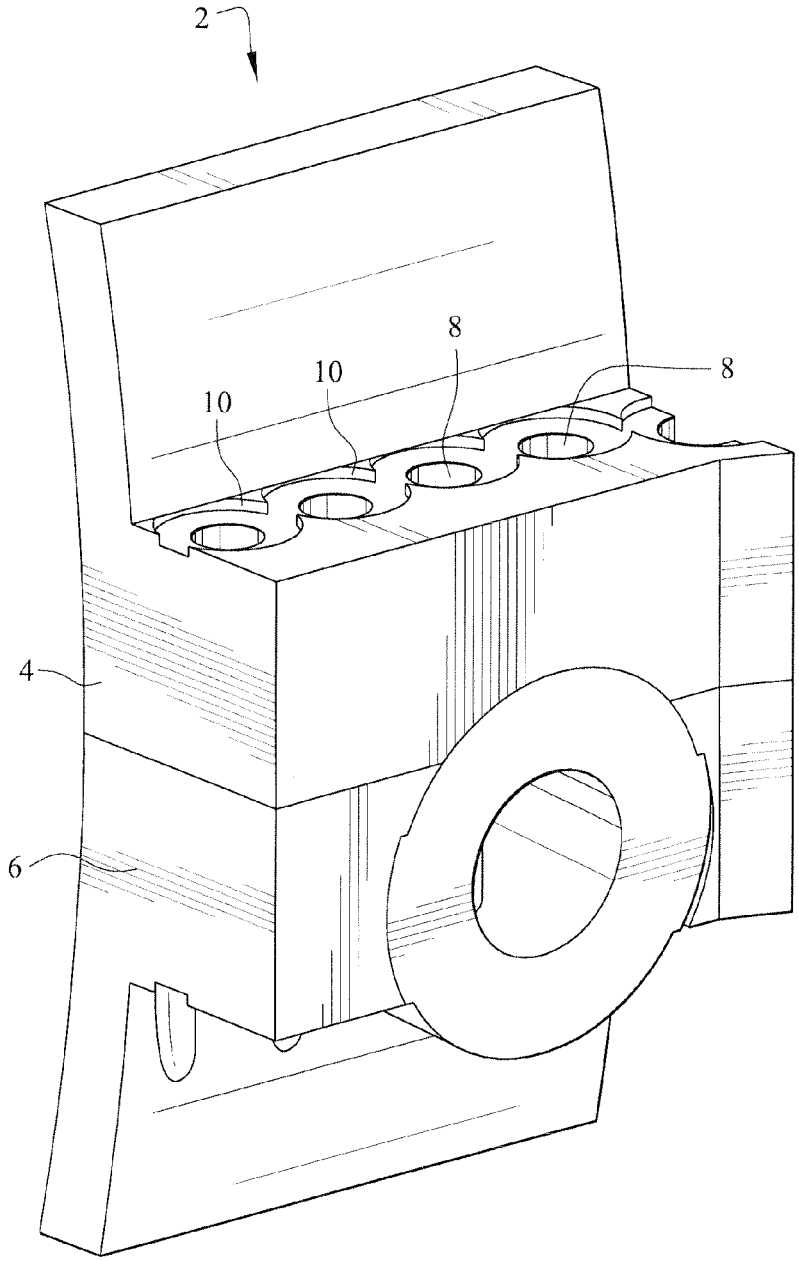
FIG. 1 is an illustration of a flange seal structure of a turbine casing.
Figure 4:
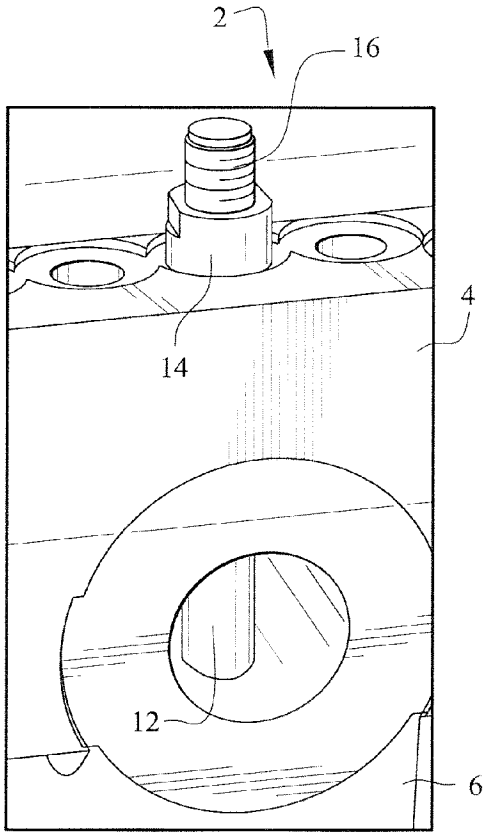
FIG. 4 is an illustration of the compression sleeve seal in a compressed, sealed configuration.
Figure 3:
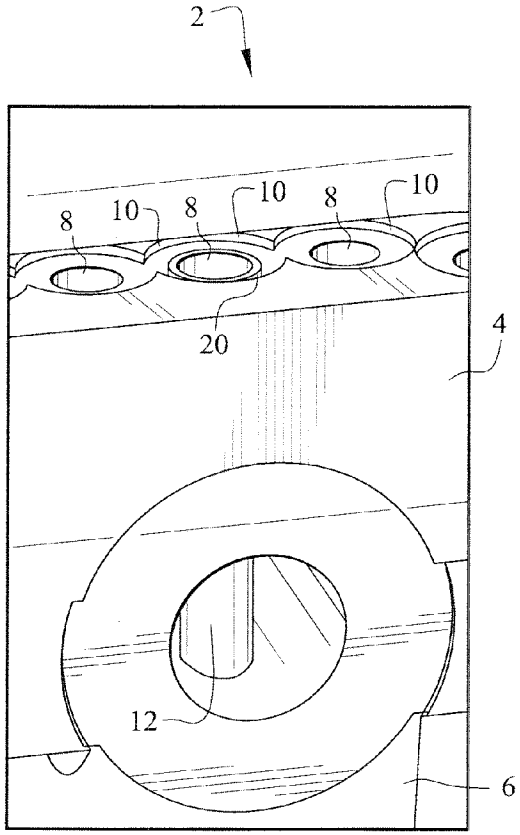
FIG. 3 is an illustration of the flange seal structure including a compression sleeve seal according to an exemplary embodiment of the invention in an uncompressed, unsealed configuration.
Figure 2:
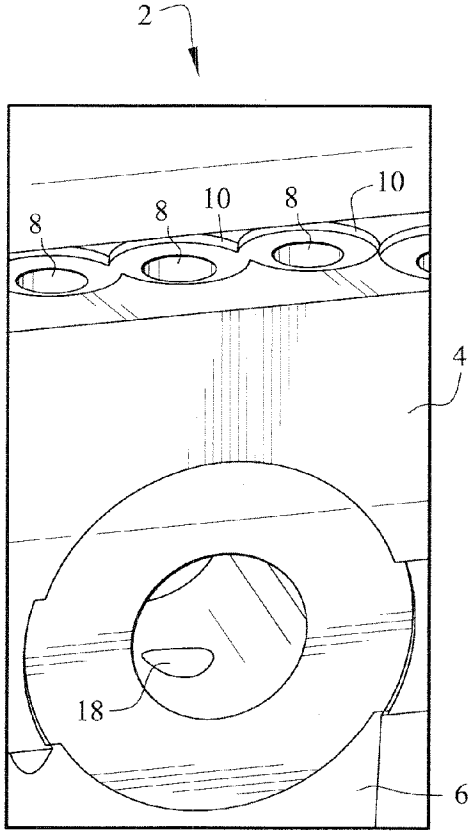
FIG. 2 is an illustration of the counterbores of the flange seal structure of FIG. 1.
Figure 9:
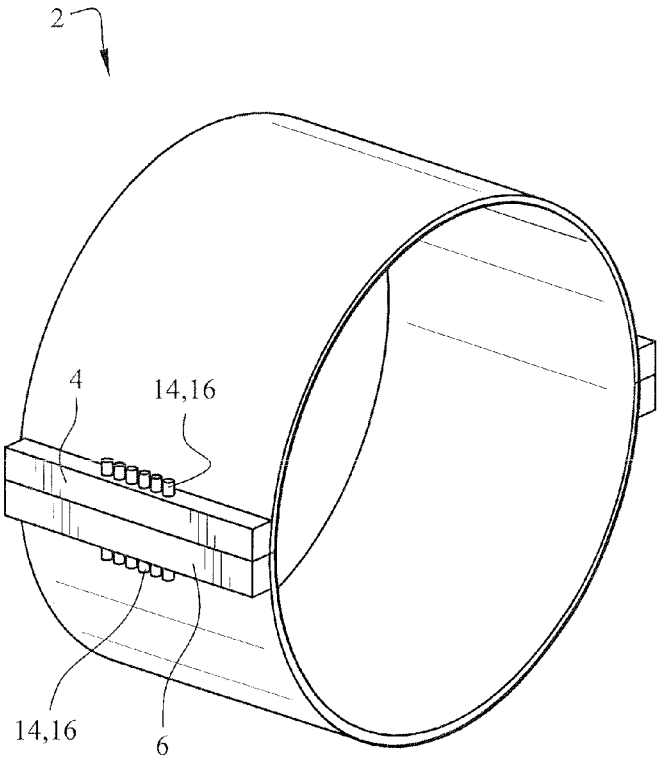
FIG. 9 is an illustration of a turbine casing including a flange seal structure.

Referring to FIGS. 1, 2 and 9, a turbine casing 2 may include two sections each having a flange 4, 6. The flange 4 may be part of an upper half casing and the flange 6 may be part of a lower half casing. It should be appreciated that while the terms "upper" and "lower" refer to the orientation of the casing sections shown in the drawings, other orientations of the casing sections and flanges are possible. It should also be appreciated that the turbine casing may include more than two sections as shown in the drawings. It should further be appreciated that the turbine casing may be a compressor casing, intermediate parts of a casing between the compressor and the combustion system, and/or a turbine rotor casing. As shown in FIG. 9 a row of fasteners 16 and corresponding nuts 14 along the flanges 4, 6 retain the joined casing sections in a sealed relationship.

Referring to FIGS. 1-4, the flange 4 includes a bore 8 that includes a counterbore 10. The flange 6 includes a bore 18 that includes a counterbore (not shown). The flanges 4, 6 may be configured not to seal against one another radially inboard of the bores 8,18 and the bores 8, 18 may form a potential leak path. A compression sleeve seal 12 is inserted into the bores 8, 18 of the flanges 4, 6 with a fastener 6, such as a stud or a bolt. The compression sleeve seal 12 is longer than the counterbore-to-counterbore length and an end 20 of the compression sleeve seal 12 extends through the bores 8, 18 of the flanges 4, 6. A nut 14 is provided on each end of the fastener 16. The nuts 14 are turned which places the fastener 16 in tension.

The nuts 14 are turned until they contact the ends 20 of the compression sleeve seal 12 which may sit slightly proud of the flange face. The release of the fastener 16 from tension compresses the fastener 16 along its longitudinal axis and creates a primary seal between the nuts 14 and the flanges 4, 6. Through Poisson's effect, the compression sleeve seal 12 extends out radially from its longitudinal axis to create a secondary seal against the bores 8, 18 of the flanges 4, 6 to seal the potential leak path.

Figure 7:
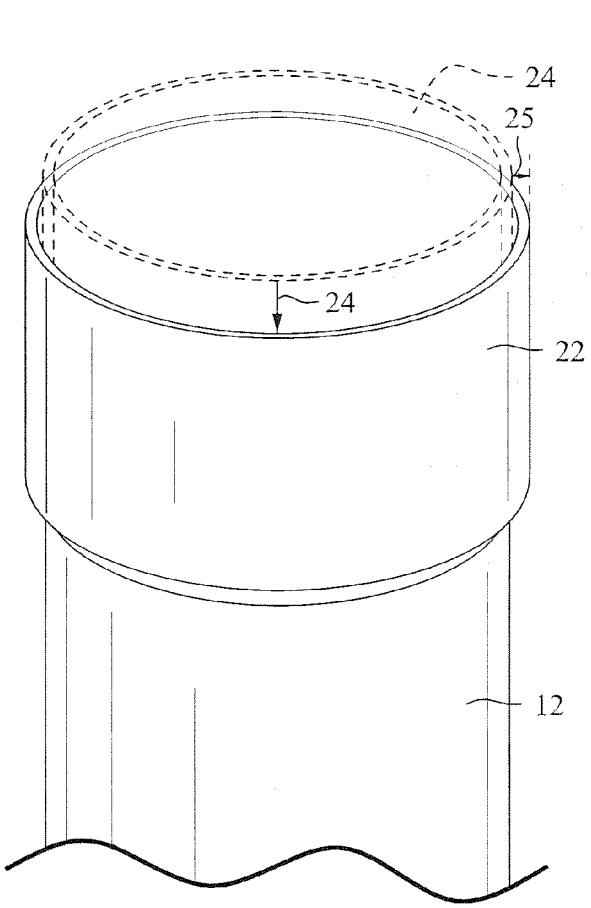
FIG. 7 is an illustration of an end of the compression sleeve seal of FIG. 5 in a compressed, sealed configuration.
Figure 6:
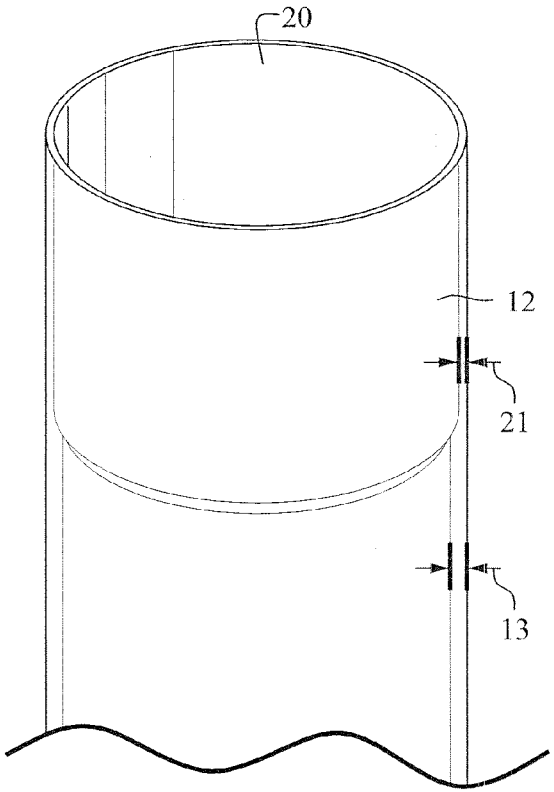
FIG. 6 is an illustration of a cross-section of an end of the compression sleeve seal of FIG. 5 in an uncompressed, unsealed configuration.
Figure 5:
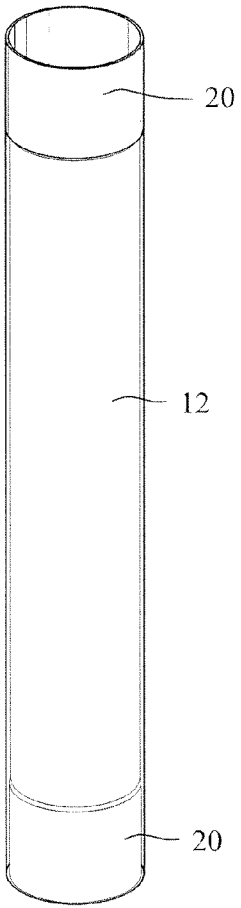
FIG. 5 is an illustration of a compression sleeve seal according to an exemplary embodiment of the present invention.
Figure 10:
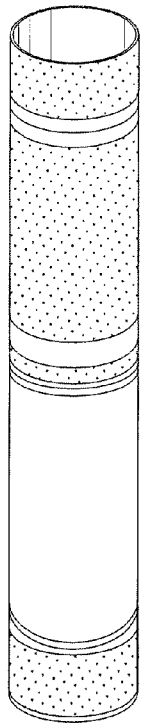
FIG. 10 is an illustration of an exemplary pattern milled into the outer diameter of a compression sleeve seal.

Referring to FIGS. 5-7, the compression sleeve seal 12 may be a tube having ends 20 that are configured to concentrate the load applied to the flanges 4, 6 by the fasteners 12 and the nuts 14 and the deformation of the compression sleeve seal 12 through Poisson's effect, resulting in a lateral deformation 25 and a predetermined contraction 24 in the longitudinal direction. For example, the ends 20 of the compression sleeve seal 12 may have a thinner wall 21 than the sleeve wall 13 of a middle portion of the compression sleeve seal 12 to provide a predetermined contraction 24 to the compressed ends 22 of the compression sleeve seal 12. In general, the compression sleeve seal 12 may be thinnest in regions in which the load and Poisson's effect are to be concentrated. The outer diameter of the compression sleeve seal 12 may be machined to concentrate or direct the load and Poisson's effect. For example, patterns may be milled into the outer diameter of the compression sleeve seal 12, such as shown in FIG. 10.

Figure 8:
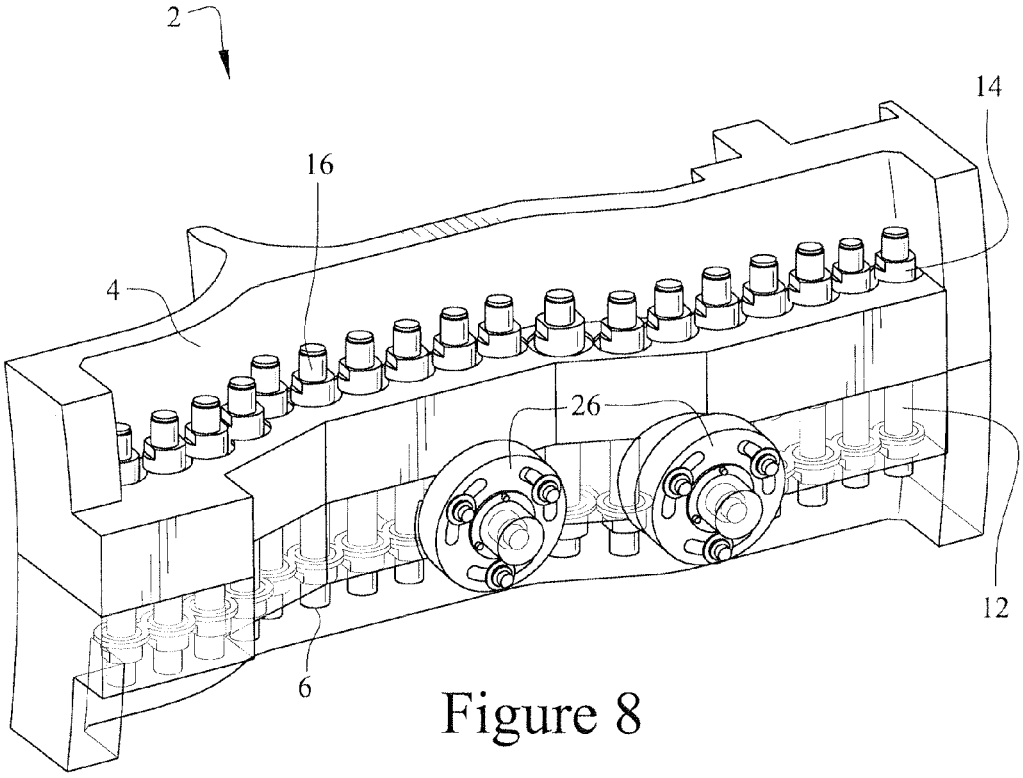
FIG. 8 is an illustration of a flange seal structure of a turbine casing and compression sleeve seals according to an exemplary embodiment.

Referring to FIG. 8 a turbine casing 2 includes a first section having a flange 4 and a second section having a flange 6. The flanges 4, 6 may be held together by horizontal joint pins 26 and sealed by compression sleeve seals 12 that form primary and secondary seals in the manner described above. The turbine casing sections may be connected initially through the compression sleeve seals 12, fasteners 16, and nuts 14 at locations along the flange except for the locations of the two horizontal joint pins 26. The horizontal joint pins 26 may then be inserted and the alignment of the flanges 4, 6 may be set. The compression sleeve seals 12 and the fasteners 16 may then be inserted into the flanges 4, 6 at the two locations of the horizontal joint pins 26 and the horizontal joint pins 26 may be torqued to secure the turbine casing sections together.

The compression sleeve seal 12 may be formed of metal, for example steel (e.g. a Cr—Mo—V steel). The material of the turbine casing may be, for example, steel (e.g. a Cr—Mo—V steel).

The use of the compression sleeve seal may allow sealing of the sections of the turbine casing without the use of gaskets and/or rope seal grooves which may have a complicated structure and/or tend to break off into the gas stream path. The compression sleeve seal is also preloaded and does not rely on the gas flow to seat the seal, as is required in existing butterfly valves. The compression sleeve seal also provides primary and secondary seals in the flange bores and does not require caps on the tops of the fasteners.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A seal for a turbine casing including a plurality of sections, each section joined at opposing flanges provided on each section, each flange including a bore and a counterbore, the seal comprising:

a compression sleeve seal that extends through the bore on each opposing flange during use, the compression sleeve seal having a length that is greater than a counterbore-to-counterbore length of two flanges when the opposing flanges are joined;

a fastener configured to extend through the compression sleeve seal; and a nut threadable on each end of the fastener, wherein ends of the compression sleeve seal are compressible between each flange and each nut to create a first seal and is radially extensible between the ends to create a second seal against each bore.

2. A seal according to claim 1, wherein the compression sleeve seal is thinner at the ends than between the ends.

3. A seal according to claim 1, wherein the compression sleeve seal comprises at least one pattern in its outer diameter to concentrate the radial extension of the compression sleeve seal between the ends.

4. A seal according to claim 3, wherein the at least one pattern is milled in the outer diameter.

5. A seal according to claim 1, wherein the compression sleeve seal is formed of metal.

6. A seal according to claim 5, wherein the metal is steel.

7. A seal according to claim 6, wherein the steel is a Cr—Mo—V alloy steel.

8. A turbine casing comprising a seal according to claim 1.

9. A turbine casing according to claim 8, wherein the flanges of the sections are not sealed inward of the bores.

10. A turbine casing according to claim 8, wherein the turbine casing is made of steel.

11. A turbine casing according to claim 10, wherein the steel is a Cr—Mo—V alloy steel.

12. The seal of claim 1, wherein the nut is configured to contact a counterbore face during use.

13. A method of sealing a turbine casing including a plurality of sections, each section joined at opposing flanges provided on each section, each flange including a bore and a counterbore, the method comprising:

inserting a compression sleeve seal into the bores of two mating flanges, the compression sleeve seal having a length that is greater than a counterbore-to-counterbore length of two opposed and joined flanges;

inserting a fastener into the compression sleeve seal;

tensioning the fastener;

threading a nut on each end of the fastener into contact with each end of the compression sleeve seal; and releasing the tension to compress the ends of the compression sleeve seal to form a first seal between each nut and each flange and radially extend the compression sleeve seal between the ends to form a second seal against the bores.

14. A method according to claim 13, wherein inserting the compression sleeve seal into the bores and inserting the fastener into the compression sleeve seal comprises inserting the compression sleeve seal with the fastener inserted therein into the bores.

15. A method according to claim 13, wherein the compression sleeve seal is thinner at the ends than between the ends.

16. A method according to claim 13, wherein the compression sleeve seal comprises at least one pattern in its outer diameter to concentrate the radial extension of the compression sleeve seal between the ends.

17. A method according to claim 16, wherein the at least one pattern is milled in the outer diameter.

18. A method according to claim 13, wherein the compression sleeve seal is formed of metal.

19. A method according to claim 18, wherein the metal is steel.

20. A method according to claim 19, wherein the steel is a Cr—Mo—V alloy steel.

21. A seal system for a turbine casing, comprising:

a first flange with a first bore hole and a first counterbore coaxial with said first borehole;

a second flange with a second bore hole and a second counterbore coaxial with said second borehole;

a hollow and substantially cylindrical compression sleeve seal in the first bore hole and the second bore hole;

a fastener configured to extend through the compression sleeve seal;

a first nut configured to engage a threaded first end of the fastener; and a second nut configured to engage a threaded second end of the fastener;

wherein:

the compression sleeve seal extends beyond the first counterbore and the second counterbore;

the first nut is threaded on the first end of the fastener while the fastener is tensioned until the first nut contacts a first end section of the compression sleeve seal;

the second nut is threaded on the second end of the fastener while the fastener is tensioned until the second nut contacts a second end section of the compression sleeve seal;

end sections of the compression sleeve seal have thinner walls than a wall of a middle section of the compression sleeve, wherein the end sections are configured to be deformed by each nut when the fastener is released from tension such that a first seal is created between each nut and each counterbore; and end sections are configured to be deformed by each nut when the fastener is released from tension such that a second seal is created between the compression sleeve seal and the first or second bore holes hole.

22. A method of sealing a turbine casing, comprising:

aligning two complementary and opposed flanges;

providing each flange with a complementary and aligned bore hole including a coaxial counterbore at a distal end of each bore hole;

inserting a compression sleeve seal into the aligned bore holes provided in the aligned and complementary opposed flanges such that ends of the compression sleeve seal extend beyond the counterbore at the distal end of each bore hole;

inserting a fastener which extends beyond ends of the compression sleeve seal;

placing the fastener under tension;

while the fastener is under tension, threading a nut on each end of the fastener until each nut comes into contact with an end of the compression sleeve seal; and releasing the fastener from tension such that the threaded nuts compress the ends of the compression sleeve seal and form a first seal between the nut and the counterbore and a second seal between the compression sleeve and the bore hole.

* * * * *

UNITED STATES PATENT AND TRADEMARK OFFICE

CERTIFICATE OF CORRECTION

PATENT NO. : 9,046,004 B2
APPLICATION NO. : 13/406943
DATED : June 2, 2015
INVENTOR(S) : Casavant et al.

It is certified that error appears in the above-identified patent and that said Letters Patent is hereby corrected as shown below:

In the Specification:

At column 1, line 30, change “fastenered” to --fastened--

In the Claims:

In claim 21 at column 6, line 7, delete “hole” after “bore holes”

Signed and Sealed this
Twenty-ninth Day of September, 2015

Michelle K. Lee

Michelle K. Lee
*Director of the United States Patent and Trademark Office*